US009782623B2

(12) United States Patent
Chuang

(10) Patent No.: US 9,782,623 B2
(45) Date of Patent: Oct. 10, 2017

(54) WRIST EXERCISER HAVING A PROTECTIVE STRUCTURE

(71) Applicant: NANO-SECOND TECHNOLOGY CO., LTD., New Taipei (TW)

(72) Inventor: Pei-Sung Chuang, New Taipei (TW)

(73) Assignee: NANO-SECOND TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/961,480

(22) Filed: Dec. 7, 2015

(65) Prior Publication Data

US 2016/0082316 A1 Mar. 24, 2016

Related U.S. Application Data

(62) Division of application No. 14/311,048, filed on Jun. 20, 2014, now Pat. No. 9,463,354.

(30) Foreign Application Priority Data

Jun. 25, 2013 (TW) ..... 102122613 A
Jun. 25, 2013 (TW) ..... 102211914 U
(Continued)

(51) Int. Cl.
*A63B 23/14* (2006.01)
*A63B 21/22* (2006.01)

(52) U.S. Cl.
CPC ..... *A63B 23/14* (2013.01); *A63B 21/22* (2013.01); *A63B 21/222* (2015.10)

(58) Field of Classification Search
CPC ..... A63B 23/14; A63B 21/222; A63B 21/22; A63B 21/0004; A63B 21/4019; A63B 21/4021
See application file for complete search history.

(56) References Cited

U.S. PATENT DOCUMENTS 3,726,146 A * 4/1973 Mishler ..... A63B 21/22 446/233
5,150,625 A * 9/1992 Mishler ..... A63B 21/22 446/233
(Continued)

FOREIGN PATENT DOCUMENTS

CN 2636909 Y 4/2011
CN 201813589 4/2011
(Continued)

OTHER PUBLICATIONS

UK Intellectual Property Office, Office Action for UK Appl No. GB1410991.2, dated Oct. 1, 2014, 6 pp.

*Primary Examiner* — Loan H Thanh
*Assistant Examiner* — Megan Anderson
(74) *Attorney, Agent, or Firm* — Muncy, Geissler, Olds & Lowe, P.C.

(57) ABSTRACT

A wrist exerciser including a housing and a gyroscopic member is disclosed. The housing has a rail and a buffer portion. The position of the buffer portion corresponds to the rail. The gyroscopic member is moveably disposed on the rail, and includes a ring and a rotor. The ring is located inside the housing and is slidably disposed on the rail. The rotor includes a ball and a shaft. The ball is located inside the housing. The shaft penetrates through the ball and the two opposite sides of the shaft are connected to the ring for the shaft to rotate relatively to the ring.

10 Claims, 14 Drawing Sheets

(30) Foreign Application Priority Data

| | | |
|---|---|---|
| Jun. 26, 2013 | (CN) | 2013 1 0260181 |
| Jun. 26, 2013 | (CN) | 2013 2 0372306 U |
| Jul. 3, 2013 | (TW) | 102123892 A |
| Jul. 3, 2013 | (TW) | 102212548 U |

(56) References Cited

U.S. PATENT DOCUMENTS

| | | | | |
|---|---|---|---|---|
| 5,353,655 | A * | 10/1994 | Mishler | A63B 21/22 310/74 |
| 5,800,311 | A | 9/1998 | Chuang | |
| 6,623,405 | B2 | 9/2003 | Chuang et al. | |
| 6,942,601 | B2 | 9/2005 | Chuang et al. | |
| 7,033,304 | B2 | 4/2006 | Chuang et al. | |
| 7,077,786 | B2 | 7/2006 | Chuang et al. | |
| 7,086,990 | B2 | 8/2006 | Chuang et al. | |
| 7,101,315 | B2 | 9/2006 | Chuang et al. | |
| 7,318,790 | B2 | 1/2008 | Chuang et al. | |
| 7,381,155 | B2 | 6/2008 | Chuang et al. | |
| 7,452,307 | B2 | 11/2008 | Chuang et al. | |
| 7,736,275 | B2 | 6/2010 | Chuang et al. | |
| 7,736,276 | B2 | 6/2010 | Chuang et al. | |
| 7,846,066 | B1 | 12/2010 | Chuang | |
| D636,037 | S | 4/2011 | Chuang et al. | |
| 8,449,436 | B2 | 5/2013 | Chuang et al. | |
| 8,834,322 | B2 * | 9/2014 | Chuang | A63B 23/14 482/44 |
| 2002/0068663 | A1 * | 6/2002 | Smith | A63B 21/22 482/45 |
| 2004/0063546 | A1 | 4/2004 | Chuang et al. | |
| 2004/0253904 | A1 * | 12/2004 | Lin | A63B 21/22 446/236 |
| 2012/0329609 | A1 * | 12/2012 | Chuang | A63B 21/22 482/44 |
| 2013/0109540 | A1 * | 5/2013 | Chuang | A63B 71/06 482/45 |
| 2013/0178336 | A1 | 7/2013 | Chuang | |
| 2013/0303337 | A1 | 11/2013 | Chuang | |
| 2013/0310224 | A1 | 11/2013 | Chuang | |
| 2014/0155226 | A1 | 6/2014 | Chuang | |
| 2014/0200115 | A1 | 7/2014 | Chuang | |

FOREIGN PATENT DOCUMENTS

| | | | |
|---|---|---|---|
| CN | 201815057 | U | 5/2011 |
| CN | 203043445 | U | 7/2013 |
| CN | 203342295 | U | 12/2013 |
| DE | 20311474 | U1 | 10/2003 |
| KR | 20120075719 | A | 7/2012 |
| TW | 348542 | | 12/1998 |
| TW | 351201 | | 1/1999 |
| TW | 364383 | | 7/1999 |
| TW | 368880 | U | 9/1999 |
| TW | M240246 | U | 8/2004 |
| TW | M391415 | U | 11/2010 |
| TW | 100220393 | * | 10/2011 |
| TW | M472539 | U | 2/2014 |

* cited by examiner

WRIST EXERCISER HAVING A PROTECTIVE STRUCTURE

CROSS REFERENCE TO RELATED APPLICATIONS

This patent application is a divisional patent application of U.S. patent application Ser. No. 14/311,048 filed on Jun. 20, 2014 and entitled "WRIST EXERCISER having a protective STRUCTURE", which is a non-provisional application claiming priority under 35 U.S.C. §119(a) on Patent Application No(s). 102211914 filed in Taiwan, Republic of China on Jun. 25, 2013, on Patent Application No. 102122613 filed in Taiwan, Republic of China on Jun. 25, 2013, on Patent Application No. 102212548 filed in Taiwan, Republic of China on Jul. 3, 2013, on Patent Application No. 201320372306.0 filed in China on Jun. 26, 2013, on Patent Application No. 201310260181.7 filed in China on Jun. 26, 2013, and on Patent Application No. 102123892 filed in Taiwan, Republic of China on Jul. 3, 2013, the entire content all of which is hereby incorporated by reference.

TECHNICAL FIELD

This patent document relates to a wrist exerciser having a gyroscope.

BACKGROUND

A wrist exerciser can be designed as an article to be held in a user's palm and rotated with the user's wrist. Some wrist exercisers utilize the principle of a gyroscope to create a resistance to the user's wrist motion for exercise. Such wrist exercisers may only need a starting force and/or torque to initiate rotating of the gyroscope. For example, a user can initiate spinning the gyroscope, e.g., such as by using a rope or a pin that is initially set in the gyroscope and pulled by the user, and/or auto-start the gyroscope by generating an initial auxiliary starting force (e.g., such as by using an auxiliary starting force mechanism, like that described in U.S. Pat. No. 7,381,155). After the gyroscope starts spinning, the user can accelerate spinning with forces applied by the wrist, thereby exercising related muscles. Depending on the applied forces, the wrist exerciser can generate a high rotation speed, e.g., greater than 10,000 revolutions per minute (rpm). The higher the rotation speed is, the stronger resistance would be created, which contributes to strengthening the user's wrist and arm.

SUMMARY

In one aspect, a wrist exerciser includes a housing and a gyroscope member. The housing includes a protective part, in which the protective part includes a rail and a buffer portion, where the position of the buffer portion corresponds to the rail. The gyroscopic member is moveably disposed on the rail, in which the gyroscope member is structured to include a ring configured inside the housing, in which the ring being slidably disposed at the rail, and a rotor including a ball and a shaft, in which the ball is configured inside the housing and the shaft penetrates the ball, the two opposite ends of the shaft being connected to the two opposite sides of the ring for the shaft to rotate relatively to the ring.

In another aspect, a wrist exerciser includes a housing and a gyroscope member. The housing includes a protective part, in which the protective part includes a rail and two buffer portions, where the rail is positioned between the buffer portions. The gyroscopic member is moveably disposed on the rail, in which the gyroscope member is structured to include a ring configured inside the housing, in which the ring being slidably disposed at the rail, and a rotor including a ball and a shaft, in which the ball is configured inside the housing and the shaft penetrates the ball, the two opposite ends of the shaft being connected to the two opposite sides of the ring for the shaft to rotate relatively to the ring.

In another aspect, a housing of a wrist exerciser includes a first shell and a second shell. The first shell includes a first cover, a first buffer portion, and a first rail connected to each other, in which the first buffer portion is between the first cover and the first rail. The second shell includes a second cover, a second buffer portion, and a second rail connected to each other, in which the second buffer portion is between the second cover and the second rail. The second shell and the first shell are attachable to each other so as to form an interior space that can accommodate a gyroscope. The first rail and the second rail, when the first shell and the second shell are attached, form a rail that supports the gyroscope and protects the gyroscope from damage.

In another aspect, a wrist exerciser includes a deformable housing and a gyroscope member. The deformable housing is structured to include a casing structure, a rail, and two or more channels along a direction of the casing structure, in which the channels penetrate through the casing structure forming an empty space. The gyroscopic member is configured to be moveably disposed on the rail, and includes a ring and a rotor. The ring is configured inside the deformable housing, and configured to be slidably disposed at the rail. The rotor includes a ball and a shaft, in which the ball is configured inside the deformable housing, the shaft penetrates the ball, and the two opposite ends of the shaft are connected to the two opposite sides of the ring for the shaft to rotate relatively to the ring. The deformable housing is structured to absorb mechanical force to protect the structure and functionality of the wrist exerciser.

Those and other aspects and associated implementations and features of disclosed wrist exerciser designs are described in greater detail in the drawings, the description and the claims.

BRIEF DESCRIPTION OF THE DRAWINGS

The disclosed wrist exerciser designs will become more fully understood from the detailed description given herein below along with the accompanying drawings which are for illustration only, thus are not limitative of the disclosed wrist exerciser designs.

Like reference symbols and designations in the various drawings indicate like elements.

DETAILED DESCRIPTION

Figure 1:
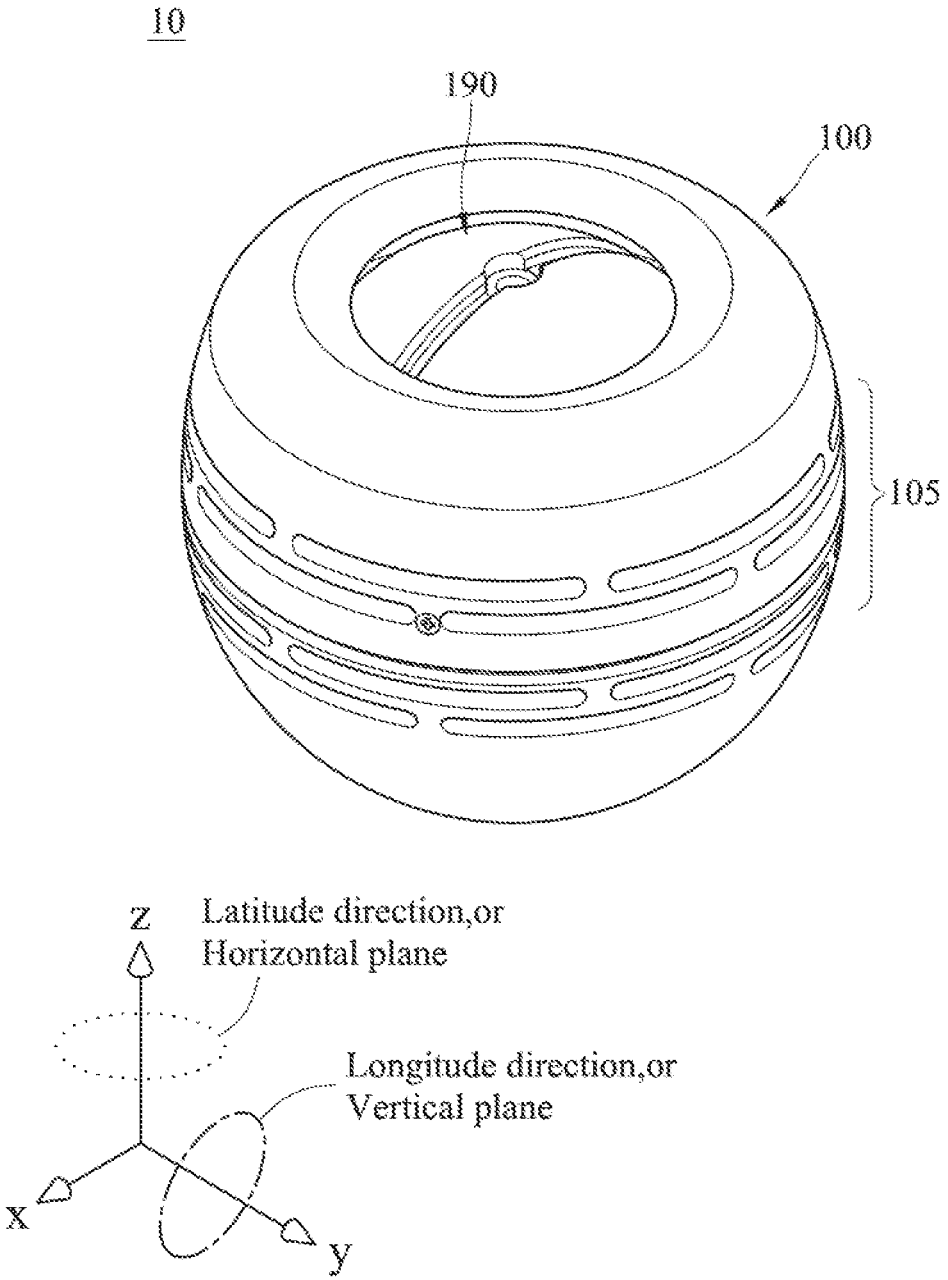
FIG. 1 shows a perspective view of a wrist exerciser according to an exemplary embodiment of the disclosed wrist exerciser designs.

The basic structure of a wrist exerciser generally includes a housing, a ring, and a gyroscope. The ring is slidably disposed on a rail formed around the inner circumference of the housing. In some designs, the gyroscope includes a shaft formed in alignment with the axis of the gyroscope. Each end of the shaft connects to the ring, allowing the gyroscope to rotate along the rail. Some examples of wrist exercisers depicting the structure and corresponding technical functions of these components and the overall wrist exerciser are described in U.S. Pat. No. 8,449,436, U.S. Pat. No. 7,846,066, U.S. Pat. No. 5,800,311, and U.S. Pat. No. 6,186,914, of which the entire disclosure of these aforementioned US patents are incorporated by reference as part of the disclosure of this patent document; and in U.S. Design Pat. No. D464,687, as well as Taiwan Patent No. 364,383.

In such designs, because the entire weight of the gyroscope is supported by the shaft at its two ends, the shaft is prone to fracture or distortion that may be caused by motions or forces due to external impacts or other actions or events. For example, one cause may include a user's accidental dropping of the wrist exerciser on the ground or other solid surfaces. If the shaft is distorted, the units (including, e.g., the housing, shaft and ring) of the wrist exerciser would be moved off their original positions, thus causing noise and vibration during use. And if the shaft is fractured, the wrist exerciser may not function at all. Therefore, a wrist exerciser of an improved structure is needed that prevents the shaft from various external impacts.

Disclosed are wrist exerciser designs having housing or casing structures that protect the components of the wrist exerciser from being impacted by external forces. The disclosed housing and/or casing structures of the wrist exercisers remedy deficiencies of various other wrist exercisers.

In one aspect of the disclosed wrist exerciser designs, a wrist exerciser includes a housing, a gyroscope, and a ring, in which the housing is structured to include a casing structure that protects the shaft from being impacted by external forces. The housing includes a protective assembly, which includes a rail and a buffer portion. The position of the buffer portion corresponds to that of the rail.

The gyroscopic member is placed inside the housing and includes a rotor and a ring. The rotor includes a shaft formed in alignment with the axis of the rotor. The two opposite ends of the shaft are rotatably connected to the ring, thereby allowing the rotor to rotate about the shaft. The ring is movably disposed at the rail that is formed around the inner circumference of the housing. Such structure allows the rotor and the ring to rotate about the axis of the ring when moving around at the rail.

In some embodiments, the buffer portion includes a first buffer portion and a second buffer portion. The rail is located between the first buffer portion and the second buffer portion. As the shaft of the rotor is disposed at the rail, the shaft is protected by the first buffer portion and the second buffer portion from external impacts. For example, an abrupt force (that may be caused by the wrist exerciser dropping on the ground) can be absorbed by the buffer zone, thereby minimizing the impact to the shaft. In reality, the outside force exerted to the housing of the wrist exerciser may be in various directions. The elasticity of the buffer portions can shield the shaft from being directly contacted or impacted by the outside force exerted to the housing and thus reduce the adverse effect of the outside force.

In some embodiments, the housing of the wrist exerciser includes a first shell and a second shell. The first shell comprises a first cover, a first buffer portion, and a first rail that are integrally formed as one piece. The first buffer portion is located between the first cover and the first rail. The second shell comprises a second cover, a second buffer portion, and a second rail that are integrally formed as one piece. The second buffer portion is located between the second cover and the second rail. The second shell is combined with the first shell to form the housing of the wrist exerciser. The first rail and the second rail are combined to form the entire rail of the wrist exerciser.

Figure 2:
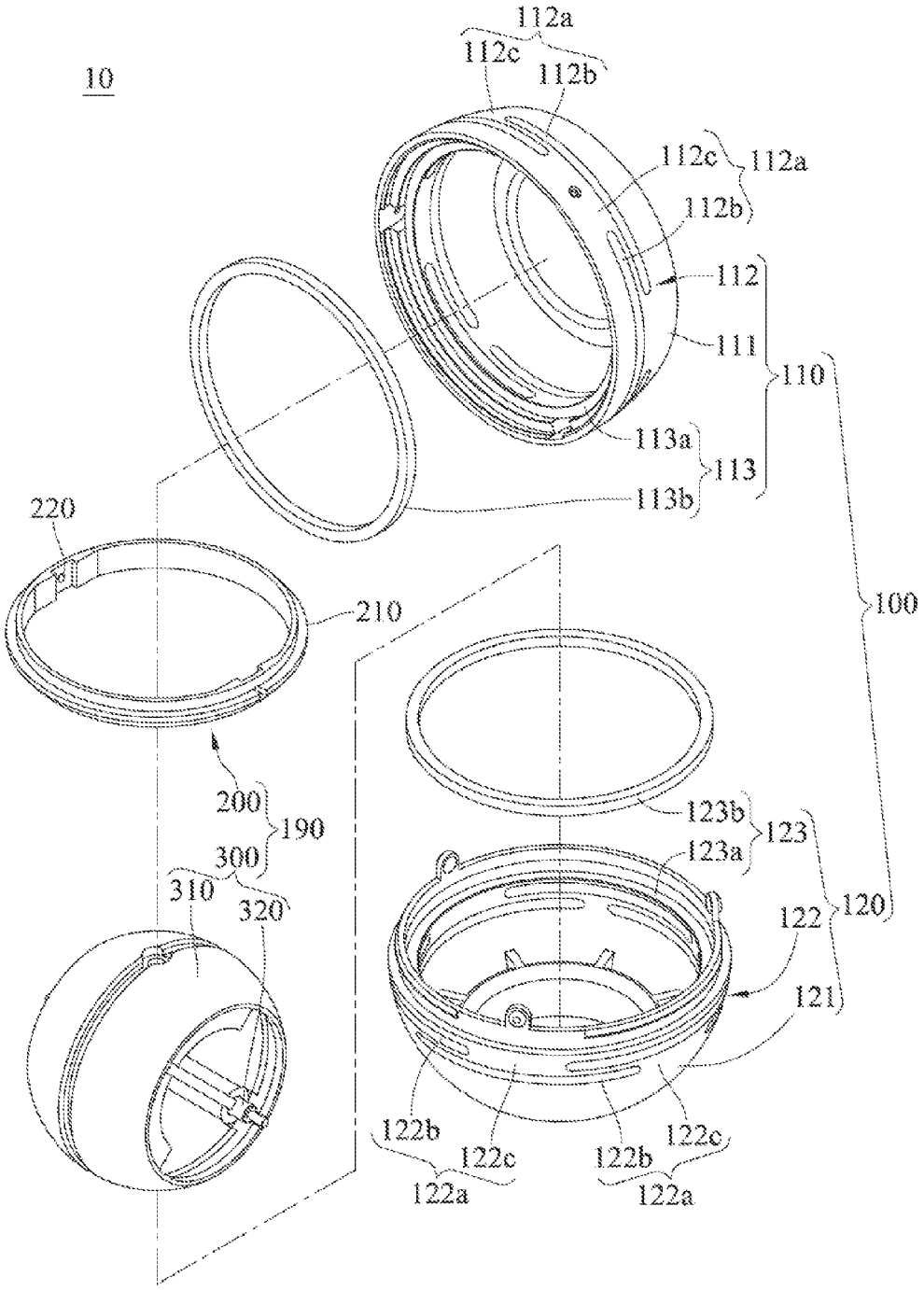
FIG. 2 shows an expanded view of FIG. 1.
Figure 3:
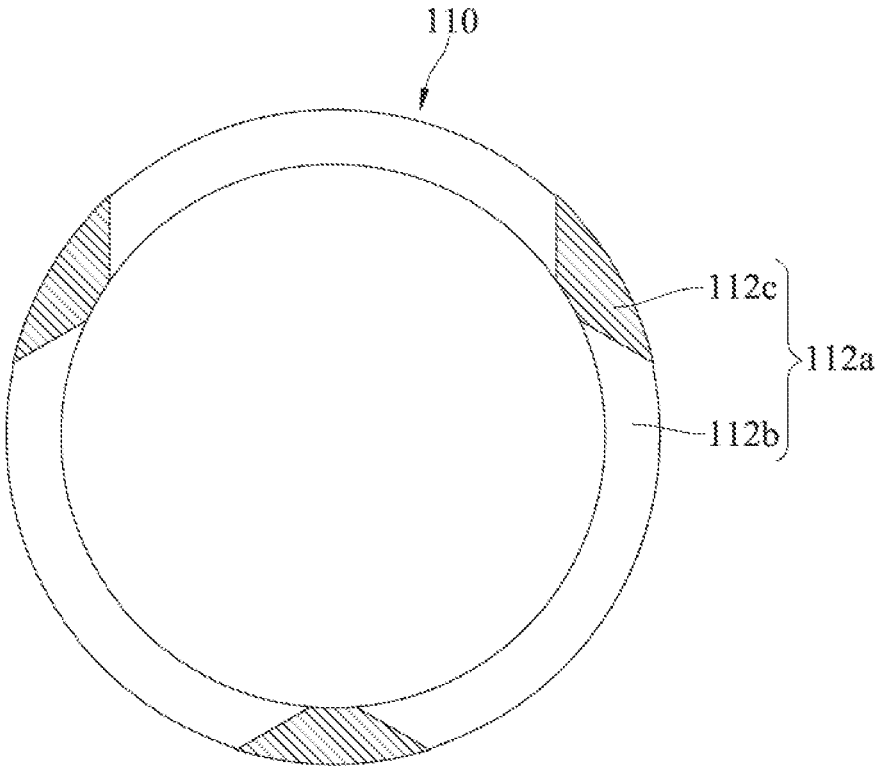
FIG. 3 shows a sectional view of a protective structure of the first shell of FIG. 1.
Figure 4A:
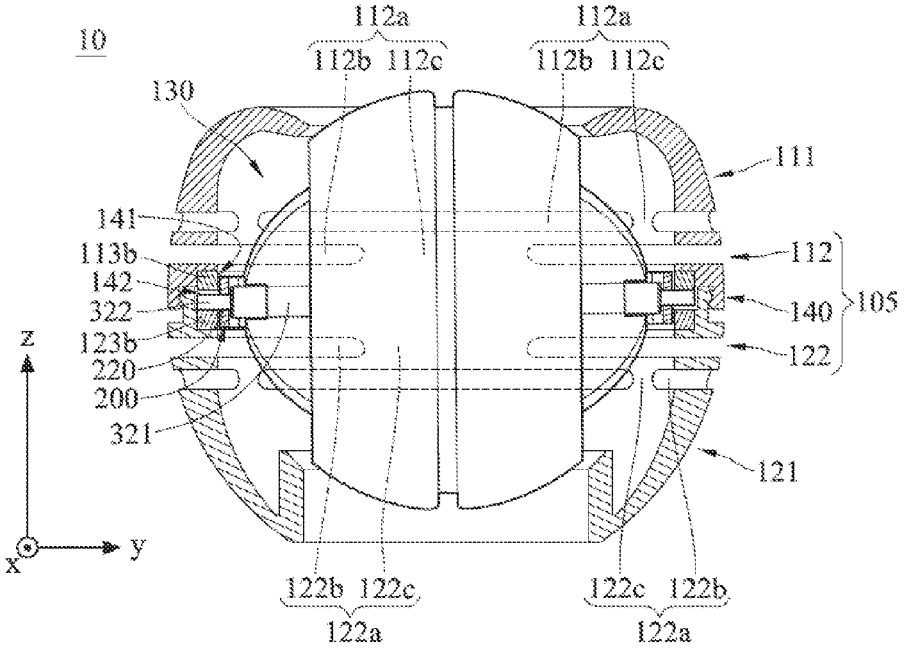
FIGS. 4A and 4B show sectional views of FIG. 1.
Figure 4B:
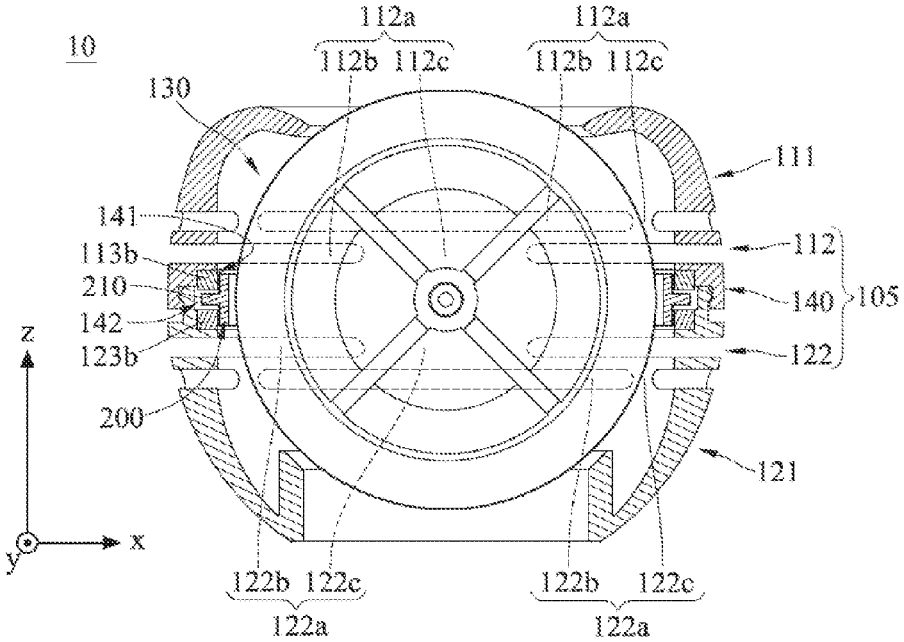

FIG. 1 through FIG. 4B show diagrams of various views of an exemplary wrist exerciser having a protective casing structure according to the disclosed technology. FIG. 1 shows a perspective view of the wrist exerciser depicting a first embodiment of the disclosed protective feature. FIG. 2 shows an exploded view of FIG. 1. FIG. 3 shows a sectional view of a protective structure of the first shell of FIG. 1. FIGS. 4A and 4B show sectional views of FIG. 1.

In this exemplary embodiment shown in FIGS. 1-4B, the wrist exerciser 10 comprises a housing 100 and a gyroscopic member 190. The housing 100 is structured to include a first shell 110 and a second shell 120. The first shell 110 includes a first cover 111, a first buffer portion 112, and a first rail 113. The buffer portions of the housing 100 (e.g., the first buffer portion 112 of the first shell 110 and a second buffer portion 122 of the second shell 120) can be configured as one or more sets of channels along a direction of the shell casing of the housing 100, e.g., such as a latitude direction, a longitude direction, a diagonal direction, etc. The channels of the buffer portions can be configured to penetrate through the shell casing of the housing 100 forming a void or empty space while the shell casing is formed as one piece. In some exemplary embodiments where the channels span along the latitude direction, for example, each channel extends a distance less than the circumference of its respective latitude, and a portion of respective channels are configured to overlap with respect to a longitudinal coordinate. The buffer portions are configured to provide a buffer region of the housing 100 to absorb mechanical force or shock, e.g., such as a force exerted when the wrist exerciser 10 is dropped. Accordingly, the buffer portions operate to protect the structure and functionality of the wrist exerciser 10.

In some embodiments, the first buffer portion 112 is between the first cover 111 and the first rail 113. Whereas, in some embodiments, the first cover 111 is between the buffer portion 112 and the first rail 113. The structure of the second shell 120 can be configured to be similar to the first shell 110. The second shell 120 includes a second cover 121, a second buffer portion 122, and a second rail 123. In some embodiments, the second buffer portion 122 is between the second cover 121 and the second rail 123. The second rail 123 can be coupled to the first rail 113 so that a protective assembly 105 of the housing 100 is formed by the first buffer portion 112, a rail 140 and the second buffer portion 122.

The gyroscopic member 190 is movably disposed in the housing 100, where at least one portion of the gyroscope member 190 is coupled to the rail 140 such that the gyroscope member 190 is permitted to move along the rail 140.

In some embodiments of the buffer portions, for example, the first buffer portion 112 has two rows of buffer parts 112*a* that are arranged side by side to each other in its surface and are parallel to the first rail 113. In this exemplary embodiment, each of the buffer parts 112*a* surrounds the gyroscopic member 190 and has a plurality of slot sections 112*b* and a plurality of isthmuses 112*c*, and the two adjacent slot sections 112*b* are spaced by one isthmus 112*c*. One of the buffer parts 112*a* is offset with respect to the other buffer parts 112*a* such that each of the isthmuses 112*c* of the buffer parts 112*a* is aligned with (corresponds to) each of the slot sections 112*b* of the other buffer parts 112*a* respectively. Thus, the horizontal plane projection (e.g. latitude direction) of the isthmuses 112*c* of one of the two buffer parts 112*a* is level with the horizontal plane projection of at least one slot sections 112*b* of the other buffer part 112*a*.

Furthermore, in this exemplary embodiment of the first buffer portion 112, as shown in FIG. 3, the width of the isthmuses 112*c* gradually decreases from the outer surface of the first shell 110 to the inner surface of the first shell 110. In some embodiments, for example, the width of the isthmuses 112*c* can be configured as constant (the two side surfaces of the isthmuses 112*c* remain equal to each other). In some embodiments, for example, the width of the isthmuses 112*c* can be configured as gradually increased from the outer surface of the first shell 110 to the inner surface of the first shell 110.

In some embodiments, for example, the first rail 113 includes a first supporting groove 113*a* and a first supporting ring 113*b*. The first supporting ring 113*b* is detachably disposed on the first supporting groove 113*a* to form the first rail 113.

As shown in the exemplary embodiment of the housing 100 in FIGS. 1-4B, the second buffer portion 122 can be configured to have two buffer parts 122*a*. Each of the buffer parts 122*a* is positioned as part of the housing 100 to at least partially surround the gyroscopic member 190. Each of the buffer parts 122*a* is structured to include a plurality of slot sections 122*b* and a plurality of isthmuses 122*c* in its surface. For example, the structures of the second cover 121 and the second buffer portion 122 of the second shell 120 can be configured to be similar to the structures of the first cover 111 and the first buffer portion 112 of the first shell 110. In this embodiment, the materials of the first cover 111, the second cover 121, and the rail 140 can include, for example, metal or plastic.

In some embodiments, for example, the second rail 123 includes a second supporting groove 123*a* and a second supporting ring 123*b*. The second supporting ring 123*b* is detachably disposed on the second supporting groove 123*a* to form the second rail 123.

The second shell 120 and the first shell 110 can attach together so that the second shell 120 and the first shell 110 form an accommodating space 130 together. For example, the first rail 113 and the second rail 123 can form an annular groove 142 of the rail 140 between the first buffer portion 112 and the second buffer portion 122. The rail 140 has an inner surface 141 which faces the accommodating space 130, and the annular groove 142 is formed on the inner surface 141.

For example, the first rail 113 and the second rail 123 are combined with each other. Therefore, when the annular groove 142 is damaged due to being rubbed or impacted by the shaft 320 (of the rotor 300 of the gyroscope member 190), the user may only need to replace the damaged first rail 113 and the damaged second rail 123 with a new first supporting ring 113*b* and a new second rail portion 123. Thus, it is more convenient to maintain the annular groove 142 of the wrist exerciser 10.

In this and some embodiments, for example, the exemplary slot sections 112*b* are oriented so that the long axes of the slot sections 112*b* are parallel to that of the annular groove 142. The long axis of the exemplary slot section 112*b* is the direction parallel to the long side of the slot section 112*b*. In some other embodiments, for example, the long axes of the slot sections 112*b* are perpendicular to that of the annular groove 142. And in some other embodiments, for example, the long axes of the slot sections 112*b* and the annular groove 142 have an acute angle there between.

In the exemplary embodiment of the wrist exerciser 10 shown in FIGS. 1-4B, the number of buffer portions of the housing 100 is two. Yet, in some embodiments, for example, the number of the buffer portion(s) is one or more than two. In such embodiments when the housing has only one buffer portion, for example, the buffer portion is disposed on the first shell 110 or the second shell 120.

In the exemplary embodiment of the wrist exerciser 10 shown in FIGS. 1-4B, neither the first cover 111 nor the second cover 121 have the disclosed channels or grooves. Yet, in some embodiments, for example, the first cover 111 and the second cover 121 have the disclosed channels or grooves to prevent the first cover 111 and the second cover 121 from being damaged or permanently deformed.

As shown in the exemplary embodiment of the wrist exerciser 10 in FIGS. 1-4B, the gyroscopic member 190 includes a ring 200 and a rotor 300. The ring 200 is located in the accommodating space 130, and has a body, an annular protrusion 210 and two holes 220. The annular protrusion 210 protrudes from the outer surface of the body of the ring 200, and is slidably disposed on the annular groove 142. The two holes 220 are at the two opposite sides of body of the ring 200. For example, the axis of one of the two holes 220 aligns with that of the other. The rotor 300 is located inside the accommodating space 130 and includes a ball 310 and a shaft 320. The shaft 320 has a supporting portion 321 and two extending portions 322. The supporting portion 321 is connected to the two extending portions 322, and the supporting portion 321 is between the two extending portions 322. The diameter of the extending portions 322 is less than the diameter of the supporting portion 321. The supporting portion 321 passes through the ball 310. The two extending portions 322 protrude from the ball 310 and insert in the holes 220 so that the ball 310 is rotatable relative to the ring 200.

The protective assembly 105 has an initial deforming point/strength which is a property of the protective assembly. When a force is greater than the initial deforming point/strength, the force is exerted to the damping element 105, and the deformation of the damping element 105 occurs. The initial deforming point/strength of the protective assembly 105 should be greater than the weight of the rotor 300. Therefore, the rotor 300 does not generate unnecessary motion during its rotation, so that the rotor 300 can spin smoothly.

For example, when the initial deforming point/strength to the protective assembly 105 is 5 kilograms, the behavior of protective assembly 105 may be what is described below. When the housing 100 is impacted and an external force of slightly greater than 5 kilograms is exerted to the protective assembly, the protective assembly 105 starts to become deformed. When the housing 100 is impacted and an external force greater than 21 kilograms is exerted to the protective assembly 105, the displacement of the buffer assembly 105 caused by the deformation is equal to the maximum distance between the ball 310 and the housing 100.

Figure 5A:
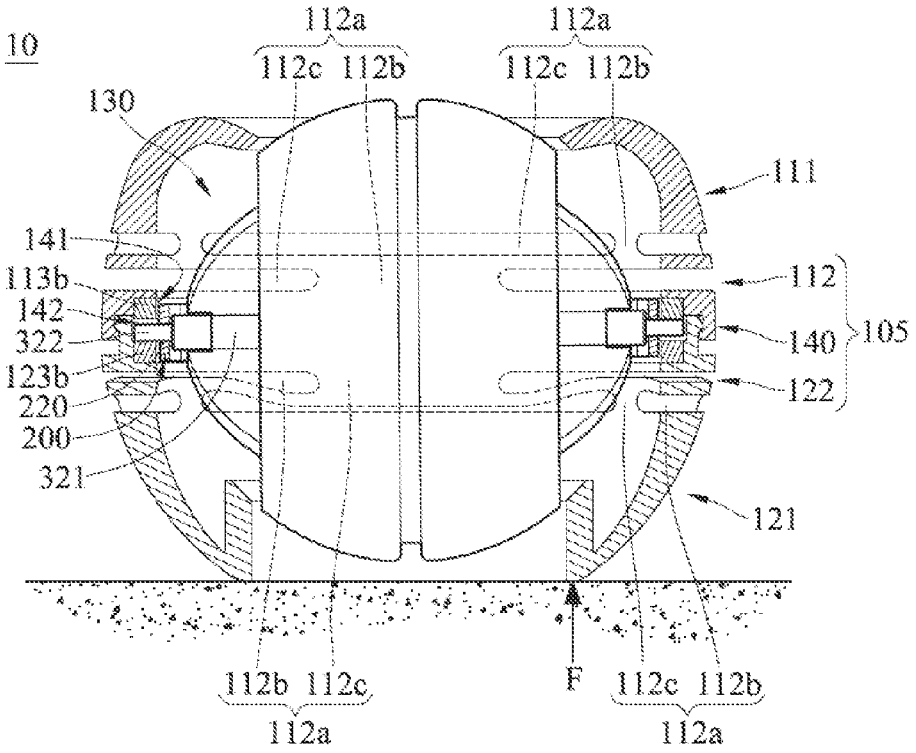
FIGS. 5A and 5B show sectional views of a wrist exerciser when being impacted.
Figure 5B:
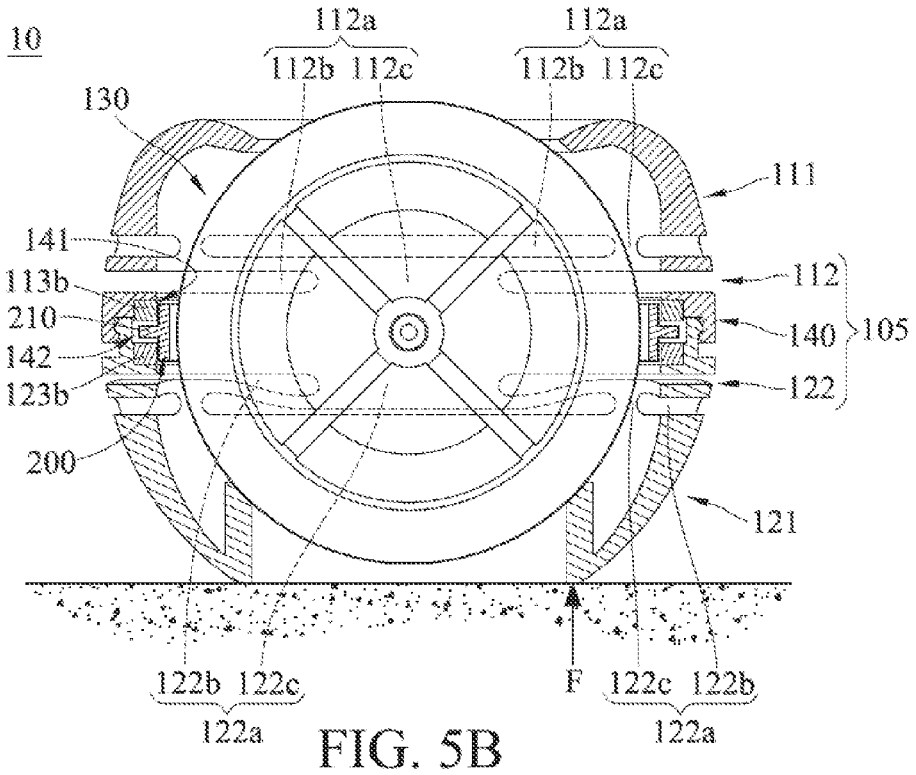

The structural assembly of the wrist exerciser 10 is precisely designed in the contacting position and contacting area where the shaft 320 contacts the annular groove 142 to avoid the wrist exerciser 10 from generating unexpected noise to affect the user's training. However, when the shaft 320 is bent, the relative position between the shaft 320 and the annular groove 142 changes, resulting in the wrist exerciser 10 generating unwanted vibration and noise. Therefore, preventing the shaft 320 from being bent is an important consideration. The following describes how to decrease the bending extent of the shaft 320 or to prevent the shaft 320 from being bent by the protective assembly 105 when the wrist exerciser 10 is impacted, in reference to FIG. 4A to FIG. 5B. FIGS. 5A and 5B show sectional views of a wrist exerciser 10 when being impacted.

FIG. 4A and FIG. 4B show the sectional views of the wrist exerciser 10 not being impacted. The weight (e.g., 300 grams) of the ball 310 is less than the initial deforming point/strength of the first buffer portion 112 and the second buffer portion 122. Therefore, the first buffer portion 112 and the second buffer portion 122 are not deformed.

As shown in FIG. 5A and FIG. 5B, when the wrist exerciser 10 falls on the ground, for example, an impact force F is applied to the housing 100. In this example, the impact point is at the second cover 121 of the second shell 120, and the magnitude of the impact force F is greater than the initial deforming point/strength of the second buffer portion 122. When the impact force F hits the second cover 121 of the second shell 120, the second buffer portion becomes deformed while the ball 310 and the shaft 320 move toward the second cover 121.

For example, the movement of the wrist exerciser 10 caused by the impact is described below, in two stages. At the first stage, the ball 310 does not contact with the housing 100. The shaft 320 and the ball 310 are pushed toward the second cover 121 accompanied with the deformation of the second buffer portion 122. Accordingly, the deformation of the second buffer portion 122 prevents the impact force F from concentrating at the position where the extending portion 322 connects to the supporting portion 321. Therefore, the force which the shaft 320 receives is lowered due to the deformation of the second buffer portion 122, so as to prevent shaft 320 from bending. During the second stage, the ball 310 contacts with the housing 100. At this stage, part of the ball 310 weight is supported by the housing 100 to lessen the force received by the shaft 320, thereby avoiding damage thereto.

Experiments of an exemplary embodiment of the wrist exerciser 10 were conducted, including subjecting the wrist exerciser 10 to impact forces, to demonstrate how the protective assembly 105 protects the wrist exerciser 10 from damaging. In one example, the weight of this embodiment of the wrist exerciser was 0.3 kilograms. The wrist exerciser 10 was tested by dropping it from one meter high to the ground. Because the protective bodies 112 and buffer portion 122 lowered the rigidity of the housing 100, the time the wrist exerciser 10 being impacted was extended (from 6.5 milliseconds to 8.5 milliseconds). Therefore, the impact force F was lowered from 204.46 kilograms/meter (kg/m) to 156.35 kilograms/meter (kg/m).

Since the impact force F (156.35 kilograms/meter) was greater than the minimum deforming force (21 kilograms/meter) of the second buffer portion 122, the impact force F received by the shaft 320 was lowered by the deformation of the second buffer portion 122. Therefore, the second buffer portion 122 prevented the shaft 320 from breaking or bending.

Although the impact point in the above examples was at the second cover 121 of the second shell 120, the location of the impact point could be elsewhere. For example, the impact point can be at the first cover 111 of the first shell 110. When the impact point is at the first cover 111 of the first shell 110, the impact to the wrist exerciser 10 is similar to what is described above where the impact point is at the second cover 121 of the second shell 120. When the impact point is at a location where the first shell 110 connects with the second shell 120, for another example: As the middle section of the housing 100 has the buffer parts 112*a* and 122*a*, the housing 100 is more flexible and shows a better deforming ability as compared with the rest of the housing without the buffer parts 112*a* and 122*a*. In other words, the housing 100 with the buffer parts 112*a* and 112*b* can sufficiently deform to press the ball 310 against the housing 100. As such, the housing 100 can buffer the impact force that would otherwise directly apply to the shaft 320 to prevent it from bending or breaking.

In addition, the first rail 113 and the second rail 123 can be connected with each other. Thus, if the annular groove 142 (formed by the first rail 113 and the second rail 123) is abraded by the shaft 320, for example, the user only needs to replace the abraded first rail 113 and the abraded second rail 123 with a new first rail 113 and a new second rail 123. Therefore, the user does not need to purchase a new wrist exerciser just because the annular groove 142 is abraded.

In some embodiments such as those described above, the first buffer portion 112 and the second buffer portion 122 have two rows of buffer parts 112*a* and two rows of buffer parts 122*a*, respectively. Yet, in some embodiments, for example, the first buffer portion 112 may only include one buffer part 112*a*; whereas in some other embodiments, for example, the first buffer portion 112 can include more than three buffer parts 112*a*.

Figure 6:
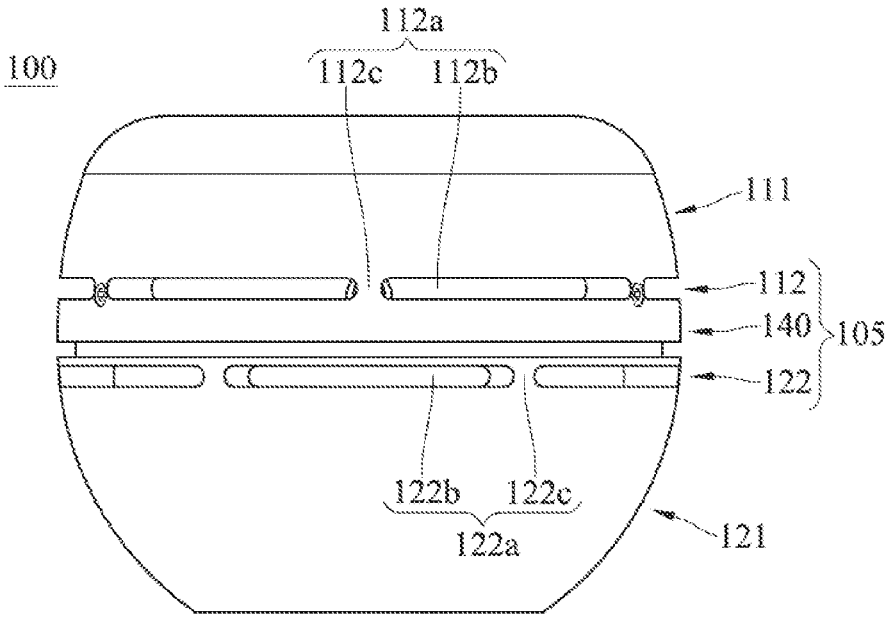
FIG. 6 shows a side view of a housing of a wrist exerciser according to an exemplary embodiment of the disclosed wrist exerciser designs.
Figure 7:
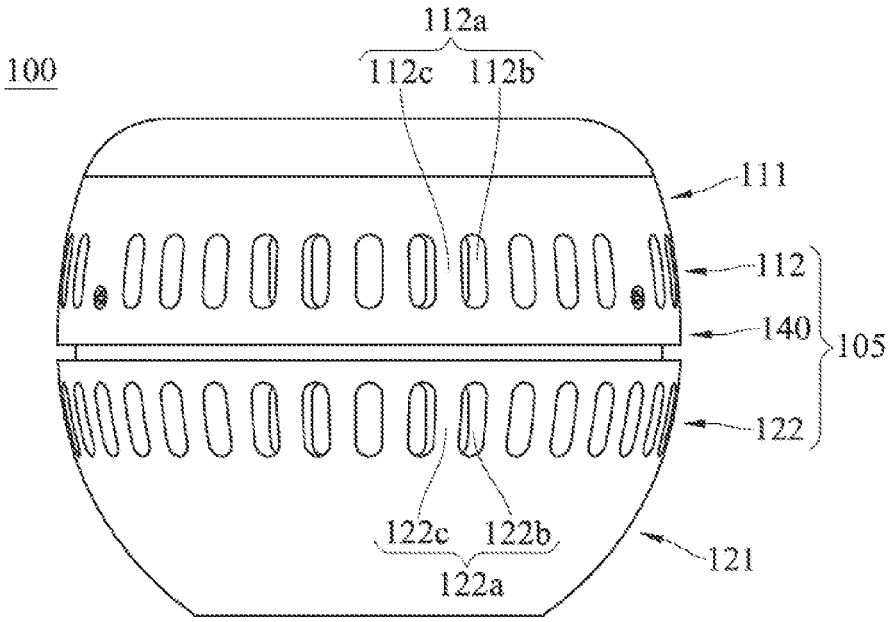
FIG. 7 shows a side view of a housing of a wrist exerciser according to an exemplary embodiment of the disclosed wrist exerciser designs.
Figure 8:
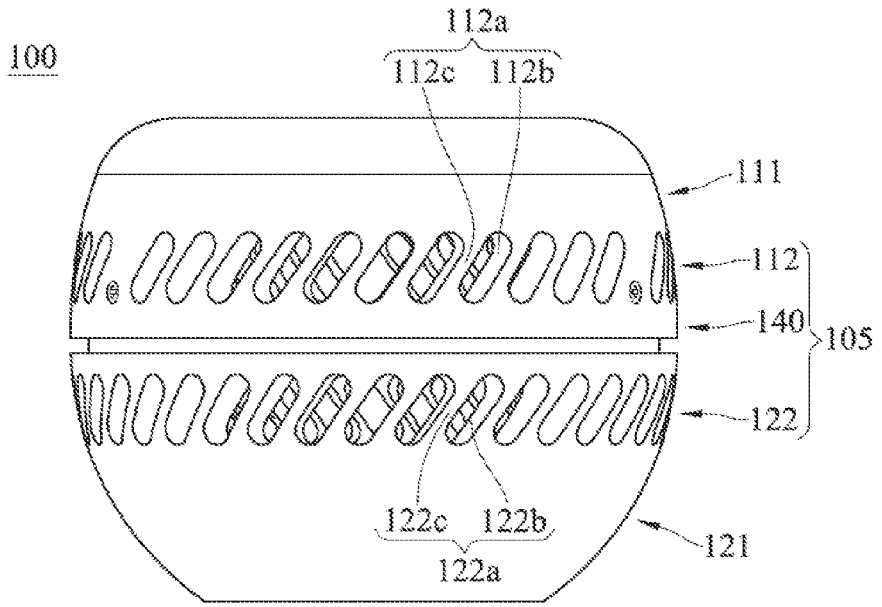
FIG. 8 shows a side view of a housing of a wrist exerciser according to an exemplary embodiment of the disclosed wrist exerciser designs.

FIG. 6 through FIG. 8 show diagrams of various views of exemplary embodiments of a wrist exerciser having a protective casing structure according to the disclosed technology. FIG. 6 shows a side view of a housing of another exemplary wrist exerciser of the disclosed technology. FIG. 7 shows a side view of a housing of another exemplary wrist exerciser of the disclosed technology. FIG. 8 shows a side view of a housing of another exemplary wrist exerciser of the disclosed technology. The exemplary embodiments shown in FIG. 6, FIG. 7, and/or FIG. 8 include some similar features to the embodiment of FIGS. 1-4B, so only the differences are described.

As shown in FIG. 6, in this exemplary embodiment, both the first buffer portion 112 and the second buffer portion 122 have only one buffer part 112*a* and 122*a* respectively. The buffer part 112*a* has a plurality of slot sections 112*b* and a plurality of isthmuses 112*c* and the buffer part 122*a* has a plurality of slot sections 122*b* and a plurality of isthmuses 122*c*. The slot sections 112*b* and 122*b* and the isthmuses 112*c* and 122*c* surround the peripheral of the ball 310 to form a circle on the surface of the ball 310 in the directions parallel to the annular groove 142.

As shown in FIG. 7, in this exemplary embodiment, the first buffer portion 112 and the second buffer portion 122 have only one buffer part 112*a* and 122*a* respectively. The buffer part 112*a* has a plurality of slot sections 112*b* and a plurality of isthmuses 112*c* and the buffer part 122*a* has a plurality of slot sections 122*b* and a plurality of isthmuses 122*c*. The slot sections 112*b* and 122*b* and the isthmuses 112*c* and 122*c* surround the peripheral of the ball 310 in the directions perpendicular to the annular groove 142.

As shown in FIG. 8, in this exemplary embodiment, the first buffer portion 112 and the second buffer portion 122 have a plurality of rows of buffer parts 112*a* and a plurality of rows of buffer parts 122*a* respectively. The buffer part 112*a* has a plurality of slot sections 112*b* and a plurality of isthmuses 112*c* and the buffer part 122*a* has a plurality of slot sections 122*b* and a plurality of isthmuses 122*c*. The long axes of the slot sections 112*b* and 122*b* and the annular groove 142 have an acute angle there between.

Figure 9:
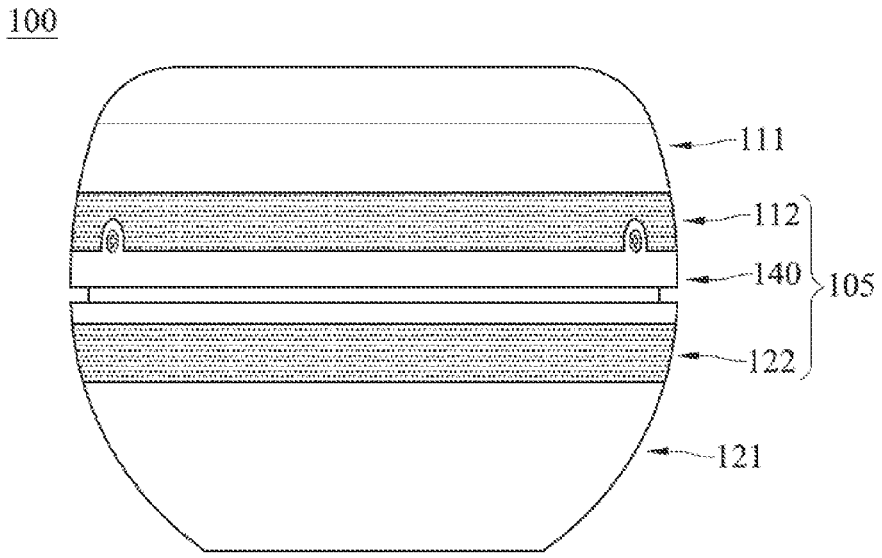
FIG. 9 shows a side view of a housing of a wrist exerciser according to an exemplary embodiment of the disclosed wrist exerciser designs.

In some embodiments, for example, the first buffer portion 112 and the second buffer portion 122 can be made from materials having a buffer property (e.g., soft materials so that the protective bodies can absorb the impact). FIG. 9 shows a side view of a housing of another exemplary wrist exerciser of the disclosed technology. In this exemplary embodiment, the materials of the first buffer portion 112 and the second buffer portion 122 include, but are not limited to, rubber. In similar embodiments, for example, the materials of the first buffer portion 112 and/or the second buffer portion 122 can include other flexible, compressible, and/or shock absorbent materials. Examples of the materials of the first buffer portion and/or the second buffer portion 122 can include polycarbonate, silicone, plastic, or like materials with elasticity properties.

For example, flexible materials or relatively rigid materials can utilized in the protective assembly 105 because of the structural design of the protective assembly 105 that enables the protective assembly 105 to resist or at least increase resistance to impact force(s) that may be exerted upon the wrist exerciser 10 (e.g., such as dropping the wrist exerciser), in which the resistance to such impact force(s) is provided by the slots or channels built into the housing structure of the wrist exerciser, thereby providing an overall deformable structure of the housing to protect the gyroscope member from damage due to the impact force(s).

Figure 10:
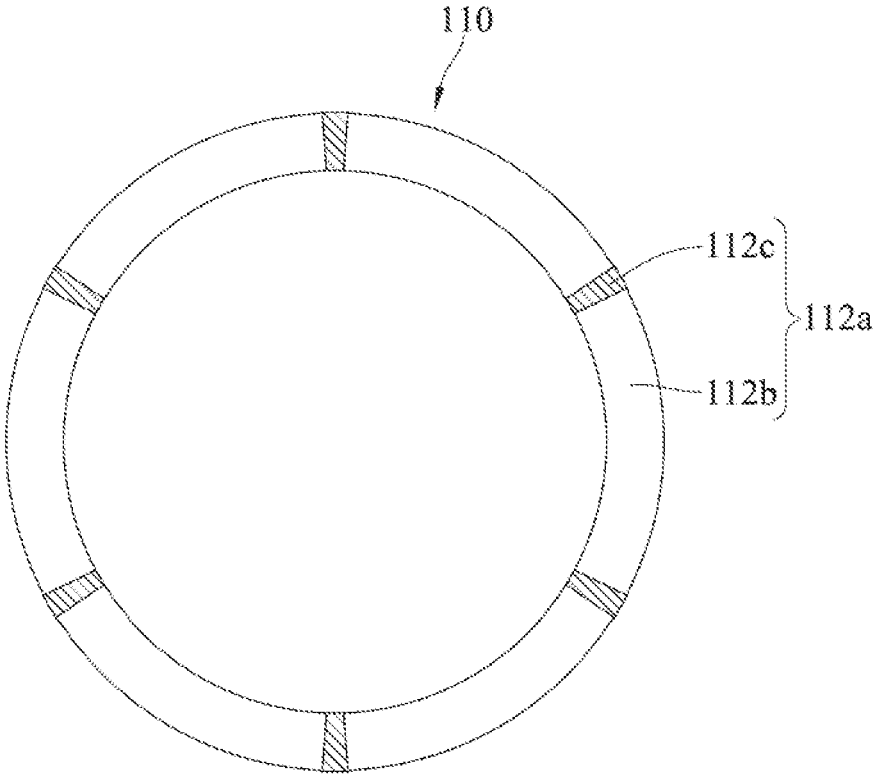
FIG. 10 shows a sectional view of a protective structure of a first shell of a wrist exerciser according to an exemplary embodiment of the disclosed wrist exerciser designs.

As previously described, for example, the amount of the slot sections 112*b* and 122*b*, and isthmuses 112*c* and 122*c*, of the first buffer portion 112 and the second buffer portion 122 can include, for example, three, but is not limited thereto. FIG. 10 shows a sectional view of a protective structure of a first shell of another exemplary wrist exerciser of the disclosed technology. In this exemplary embodiment, the amount of the slot sections 112*b* and 122*b* and isthmuses 112*c* and 122*c* of the first buffer portion 112 and the second buffer portion 122 are, for example, six.

In addition, for example, the width of the isthmuses can be configured to gradually decrease from the outer surface of the first shell to the inner surface of the first shell along the radial direction, but is not limited thereto. In some embodiments, for example, the width of the isthmuses is constant (the two side surfaces of the isthmuses remain parallel to each other). In some other embodiments, the width of the isthmuses can be configured to gradually increase from the outer surface of the first shell to the inner surface of the first shell along the radial direction.

Figure 11:
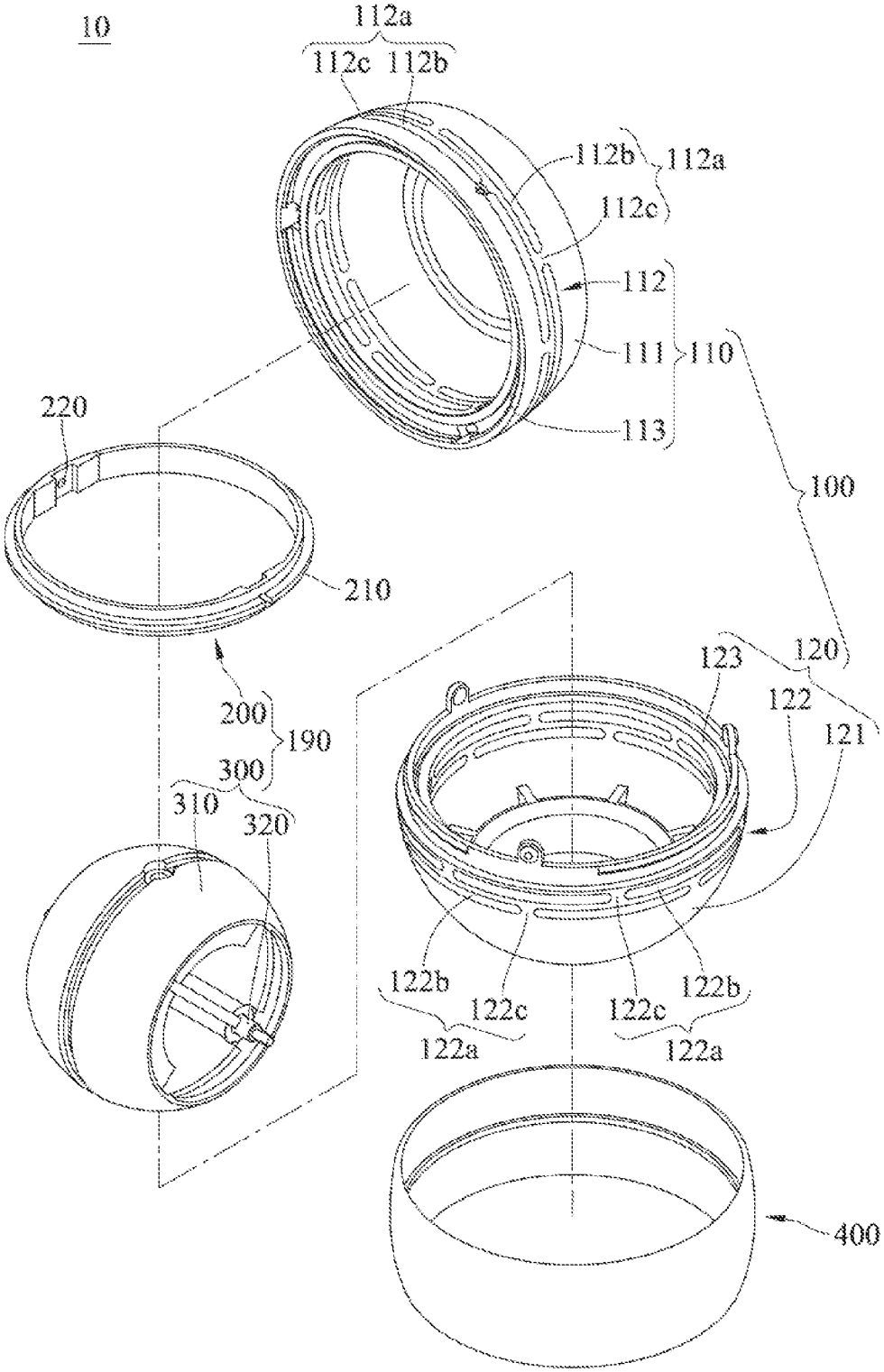
FIG. 11 shows an expanded view of a wrist exerciser according to an exemplary embodiment of the disclosed wrist exerciser designs.

For example, in some embodiments, the first supporting groove 113*a* and the first supporting ring 113*b* are combined with each other. Yet, in some embodiments, for example, the first supporting groove 113*a* and the first supporting ring 113*b* can be integrally formed into one piece. FIG. 11 shows an expanded view of an exemplary wrist exerciser of the disclosed technology. In this exemplary embodiment, the first rail 113 and the second rail 123 are integrally formed into one piece.

In addition, in some embodiments of the wrist exerciser 10, the wrist exerciser 10 further includes a protective ring 400, which is detachably disposed on the protective assembly 105 of the housing 100 so that the user may use the wrist exerciser 10 more comfortably.

In some embodiments, the first rail 113 further includes a first supporting groove 113*a* and a first supporting ring 113*b*. The first supporting ring 113*b* is detachably disposed on the first supporting groove 113*a* to form the first rail 113. The rail forces the ball and the shaft to move together when the buffer portions deforms plastically. The concentration of the impacting force at the combined position, where the extending portion combines with the supporting portion, is avoided. Therefore, the buffer portions share the impact force received by the shaft by the plastic deformation of the buffer portions to avoid the shaft from becoming bent or broken due to heavy impact. In addition, when the ball contacts the housing, the housing is capable of supporting the weight of the ball to decrease the impacting force received by the shaft. Therefore, the housing shares the impacting force which the shaft receives with the buffer portion of the housing. Furthermore, since the first rail and the second rail are combined with each other, when the annular groove formed by the first rail and the second rail is broken, the user only needs to replace the broken first rail and the abraded second rail with a new first rail and a new second rail. Therefore, the user does not need to purchase a new wrist exerciser just because the annular groove is abraded.

Figure 12A:
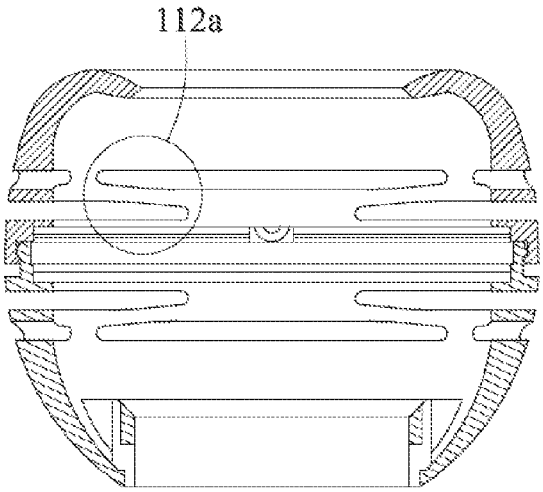
FIG. 12A shows a side view of a diagram depicting an exemplary protective structure of the disclosed wrist exerciser designs.
Figure 12B:
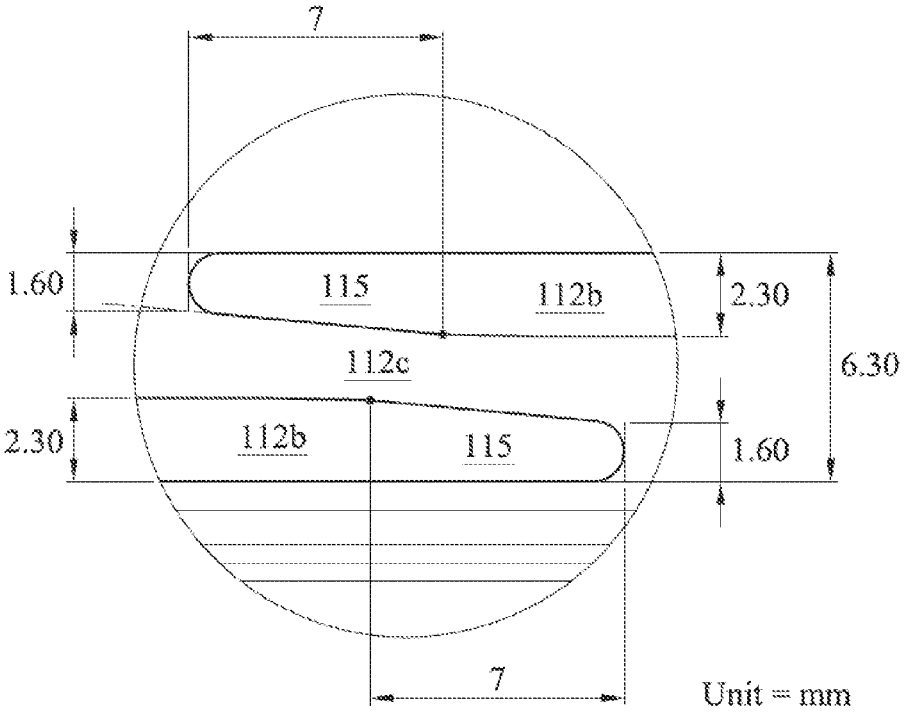
FIG. 12B shows an expanded view of buffer part 112*a* (including 112*b* and 112*c*) shown in FIG. 12A.

Referring to FIGS. 12A and 12B (an expanded view of buffer part 112*a* as shown in FIG. 12A), slot sections 112*b* are tapered at one end, leaving the narrowest part to be 1.6 mm and the widest part to be 2.3 mm in a preferred embodiment. The width of isthmus 112*c* plus the two slot sections 112*b* sandwiching the isthmus is preferably 6.3 mm. The tapered portions 115 of buffer parts 112*b* each approximate 7 mm in length.

Figure 13:
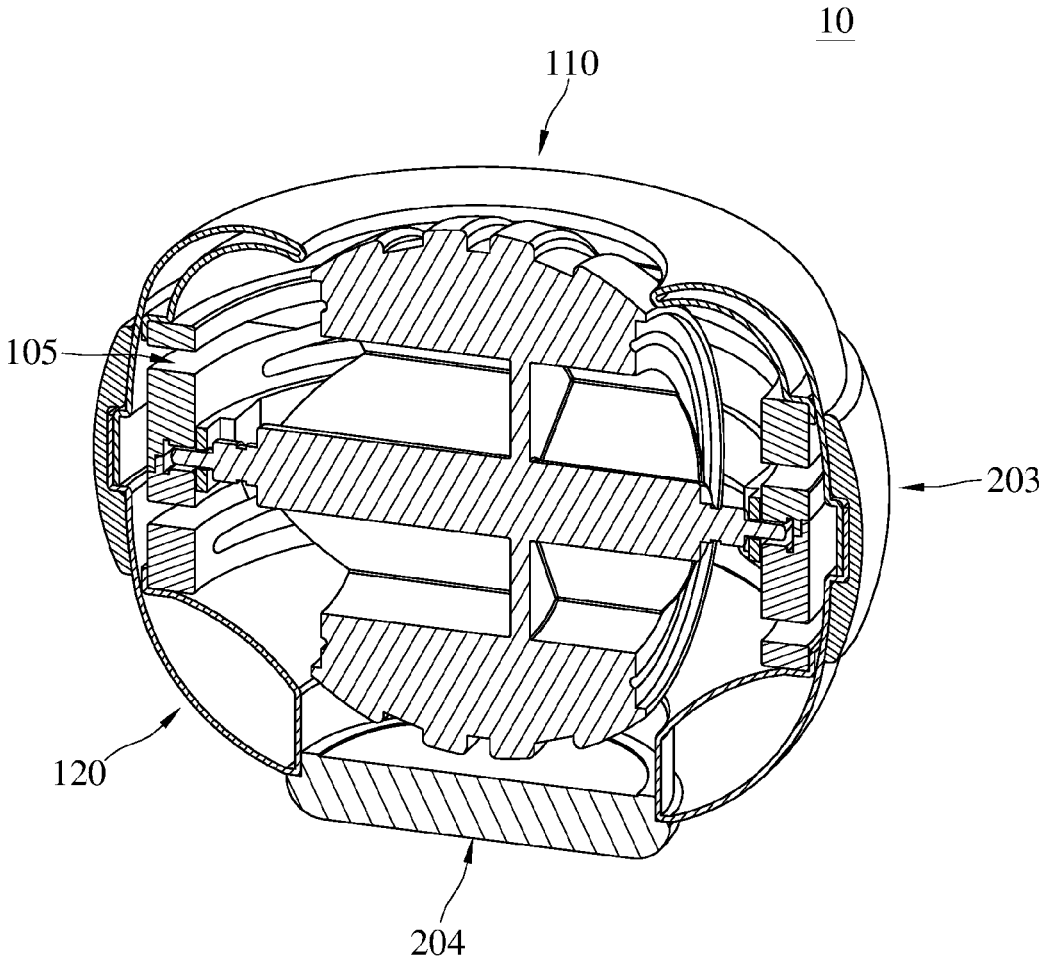
FIG. 13 shows a cross-sectional view of an exemplary embodiment of the wrist exerciser where a protective structure is not integrally formed with the housing.
Figure 14:
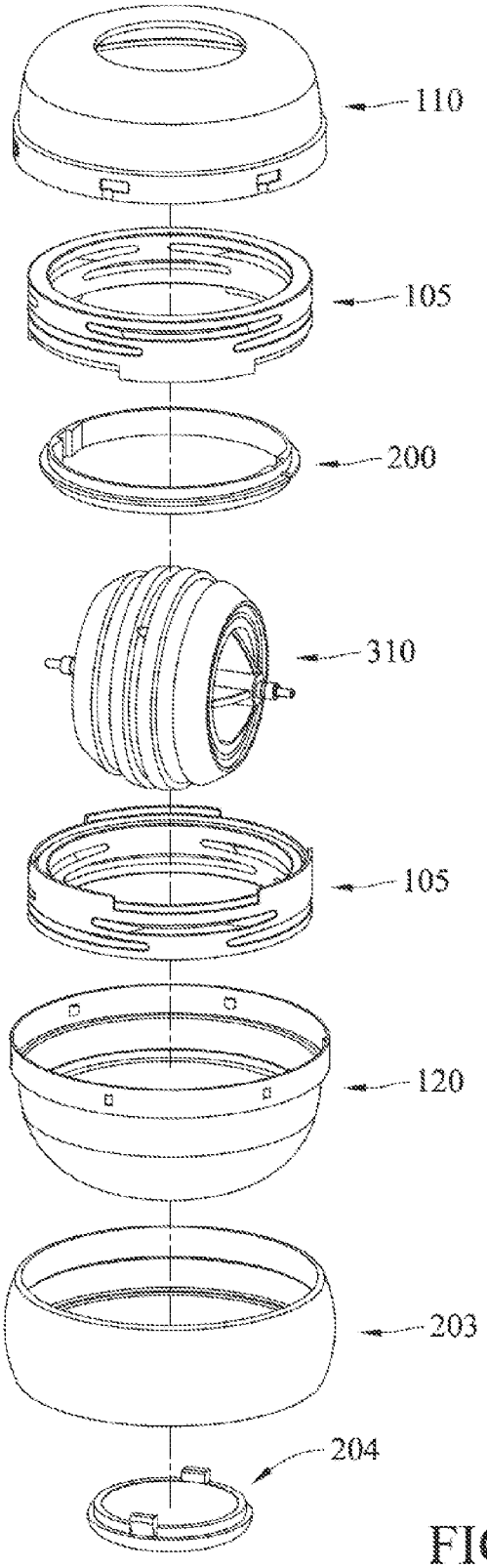
FIG. 14 shows an exploded view of the embodiment as illustrated in FIG. 13.

In some embodiments, for example, the protective assembly 105 is not formed integrally with the housing 100 but is a separate part, as illustrated in FIG. 13. Referring to FIG. 13, the protective assembly 105 is disposed within the outside housing 100. The protective assembly 105 can be preferably made of polycarbonate, plastic, or like materials with elasticity properties. The outside housing 100 can be preferably made of metallic and/or alloy materials and includes a first shell 110 and a second shell 120. In some embodiments, a band 203 can be disposed around the central part of the housing 100. The band 203 can be preferably made of rubber materials, which serves as a further protection to the gyroscopic member 190 and for better grasp by a user. A cap 204 is detachably mounted onto the second shell 120, and can include a speedometer (to sense and display the rotation speed of the rotor).

Figure 15:
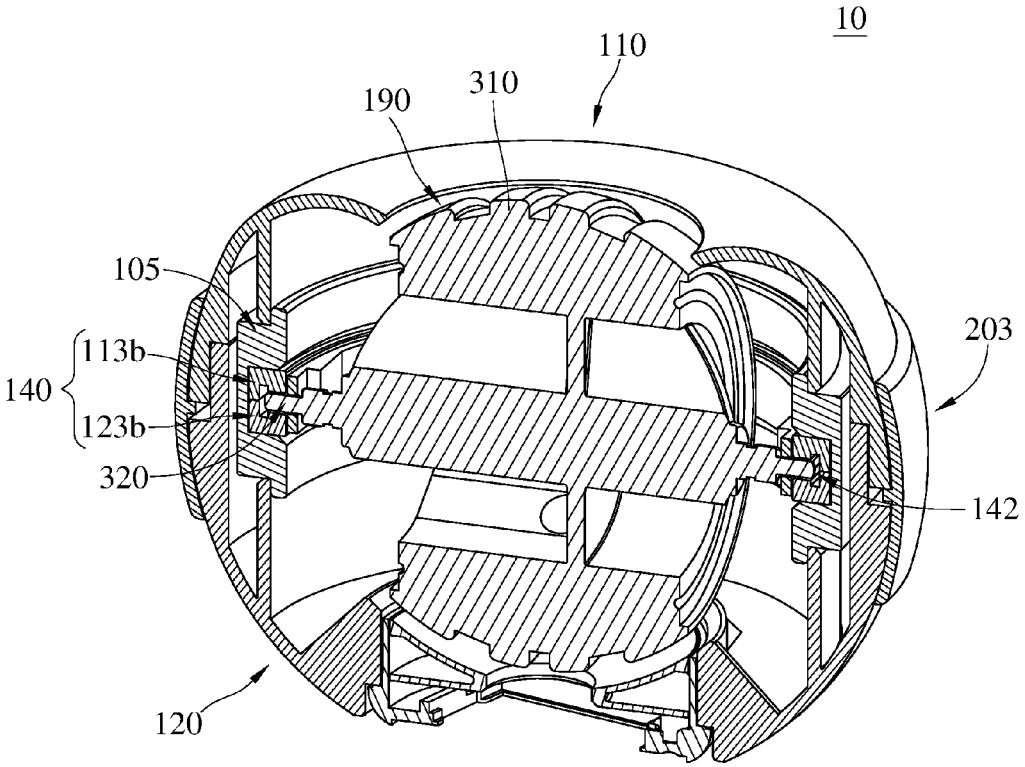
FIG. 15 shows a cross-sectional view of an exemplary embodiment of the wrist exerciser where supporting rings are embedded inside a protective structure.
Figure 16:
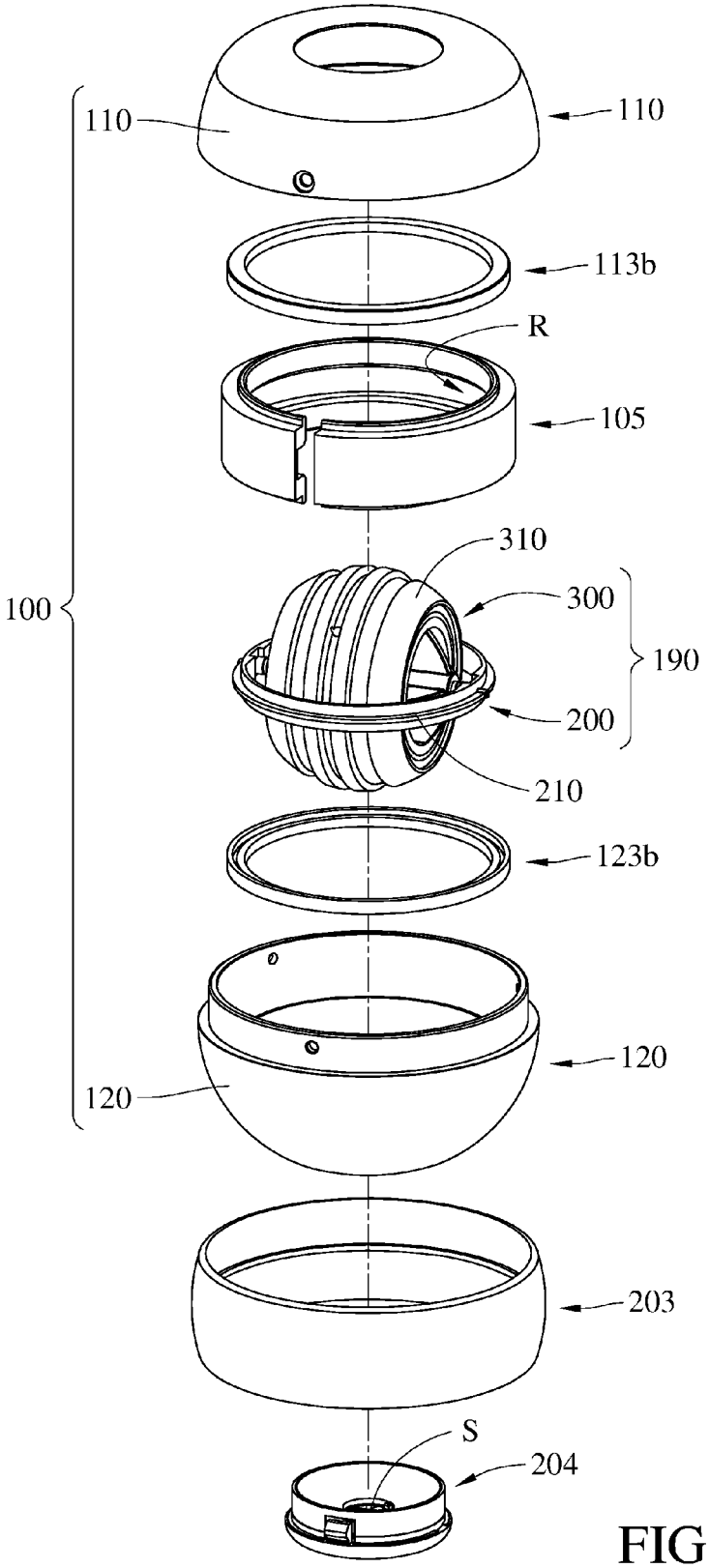
FIG. 16 shows an exploded view of the embodiment as illustrated in FIG. 15.

In some embodiments, for example, the protective assembly 105 can be made of materials such as silicone which can absorb shocks and vibrations. Because of such properties, the protective assembly 105, whether including buffer portions 112 and 122, can absorb shocks and thus isolate the gyroscopic member 190 from the external impact. As shown in FIGS. 15 and 16, the shaft 320 of the gyroscopic member 190 is disposed between the first supporting ring 113*b* and second supporting ring 123*b*. The first supporting ring 113*b* and second supporting ring 123*b* are embedded within the protective assembly 105 and form a rail space for the shaft 320 to rotate along therein.

In detail, as shown in FIGS. 15 and 16, the wrist exerciser 10 includes a housing 100, the protective assembly 105, a rail 140, the gyroscopic member 190, a band 203 and a cap 204. The housing 100 includes a first shell 110 and a second shell 120, and the first shell 110 and the second shell 120 are connected to each other. The housing 100 is made of metallic or alloy materials. The protective assembly 105 is located in the housing 100. The protective assembly 105 has an annular recess R located at an inner surface of the protective assembly 105. The rail 140 is disposed in the annular recess R, and the rail 140 is formed by a first supporting ring 113*b* and a second supporting ring 123*b*. The rail 140 has a rail space 142, which is formed between the first supporting ring 113*b* and the second supporting ring 123*b*, located at an inner surface of the rail 140. The gyroscopic member 190 moveably disposed on the rail 140, and the gyroscopic member 190 includes a ring 200 and a rotor 300. The ring 200 is located inside the housing 100 and is slidably disposed on the rail 140. The ring 200 has an annular protrusion 210 slidably disposed within the rail space 142. The rotor 300 includes a ball 310 and a shaft 320. The shaft 320 penetrates the ball 310. Two opposite ends of the shaft 320 are connected to the ring 200 for the shaft 320 to rotate relatively to the ring 200. Therefore, the two opposite ends of the shaft 320 are rotatably and slidably disposed in the rail space 142. The band 203 is disposed around the central part of the housing 100, and the band 203 is formed of a flexible and compressive material including rubber. The band 203 is configured to provide further protection to the wrist exerciser 10 by absorbing at least a portion of the impact force and to provide a frictional surface for a user to grasp the wrist exerciser 10. The cap 204 is detachably coupled to the second shell 120 of the housing 100 in this embodiment. In other embodiments, the cap 204 is detachably coupled to the first shell 110. The cap 204 includes a speedometer S configured to detect a rotation speed of the rotor 300 and display the detected speed to a user on the wrist exerciser 10. The protective assembly 105 can be made of materials such as silicone, polycarbonate or plastic which can absorb shocks and vibrations. Because of such properties, the protective assembly 105 can absorb shocks or impact force by deformation. When the protective assembly 105 deforms, the rail 140 guides the ball 310 and the shaft 320 to move. Thus, the protective assembly 105 isolates the gyroscopic member 190 from the external impact.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described, and other implementations, enhancements and variations can be made based on what is described and illustrated in this patent document.

What is claimed is:

1. A wrist exerciser, comprising:

a housing;

a protective assembly located in and surrounded by the housing, the protective assembly having an annular recess located at an inner surface of the protective assembly;

a rail disposed in the annular recess, the rail formed by a first supporting ring and a second supporting ring, and a rail space formed between the first supporting ring and the second supporting ring; and a gyroscopic assembly moveably disposed on the rail, the gyroscopic assembly comprising:

a ring which is inside the housing and is slidably disposed on the rail; and a rotor being inside the housing and comprising a ball and a shaft, the shaft penetrating the ball, with its two opposite ends connected to the ring for the shaft to rotate relatively to the ring, and the two opposite ends of the shaft rotatably and slidably disposed in the rail space;

wherein the protective assembly is structured to absorb an impact force by deformation to protect the structure and functionality of the wrist exerciser.

2. The wrist exerciser according to claim 1, wherein the housing has a first shell and a second shell which are connected to each other.

3. The wrist exerciser according to claim 2, further comprising a cap detachably coupled to the first shell or the second shell of the housing.

4. The wrist exerciser according to claim 3, wherein the cap includes a speedometer configured to detect a rotation speed of the rotor and display the detected speed to a user on the wrist exerciser.

5. The wrist exerciser according to claim 1, further comprising a band disposed around a central region of the housing, wherein the band is configured to provide further protection to the wrist exerciser by absorbing at least a portion of the impact force and to provide a frictional surface for a user to grasp the wrist exerciser.

6. The wrist exerciser according to claim 5, wherein the band is formed of a flexible and compressive material including rubber.

7. The wrist exerciser according to claim 1, wherein the protecting assembly is made of silicone, polycarbonate or plastic.

8. The wrist exerciser according to claim 1, wherein the ring has an annular protrusion slidably disposed within the rail space.

9. The wrist exerciser according to claim 1, wherein the housing is made of metallic or alloy materials.

10. The wrist exerciser according to claim 1, wherein the rail guides the ball and the shaft to move when the protective assembly deforms.

* * * * *